United States Patent [19]

Schulte et al.

[11] 4,123,333

[45] Oct. 31, 1978

[54] DUCT EQUIPMENT FOR EXHAUSTING COKE GASES

[75] Inventors: Fritz Schulte, Meerbusch; Johann G. Riecker, Ratingen; Günther Rozas, Erkrath, all of Fed. Rep. of Germany

[73] Assignee: Hartung, Kuhn & Co. Maschinenfabrik GmbH, Dusseldorf, Fed. Rep. of Germany

[21] Appl. No.: 766,217

[22] Filed: Feb. 7, 1977

[30] Foreign Application Priority Data

Feb. 9, 1976 [DE] Fed. Rep. of Germany ..... 2604950
May 17, 1976 [DE] Fed. Rep. of Germany ..... 2621889

[51] Int. Cl.[2] ..... C10B 27/06

[52] U.S. Cl. ..... 202/255; 202/263; 98/115 VM

[58] Field of Search ..... 98/115 VM; 266/158, 266/159; 202/254, 255, 258, 259, 263, 269

[56] References Cited

U.S. PATENT DOCUMENTS 3,018,503 1/1962 Hijiya et al. ..... 98/115 VM X
3,602,128 8/1971 Lindkvist ..... 98/115 VM
3,803,473 4/1974 Schoen et al. ..... 202/263

FOREIGN PATENT DOCUMENTS 2,326,630 12/1974 Fed. Rep. of Germany ..... 202/263
2,513,449 5/1976 Fed. Rep. of Germany.
1,412,470 11/1975 United Kingdom ..... 98/115 VM

*Primary Examiner*—Morris O. Wolk
*Assistant Examiner*—Michael S. Marcus
*Attorney, Agent, or Firm*—Dressler, Goldsmith, Clement, Gordon & Shore, Ltd.

[57] ABSTRACT

Equipment for exhausting gases from a collecting device including an outer collection duct having longitudinal openings covered by a flexible belt. The collecting device is shifted along said duct while lifting the belt off the collection duct. Located within the outer collection duct is a longitudinally extending arcuate member defining on its side opposite to said belt an inner collection channel for directing exhaust gases out through the collection channel while preventing contact of said exhaust gases with the belt to prevent deterioration thereof.

7 Claims, 5 Drawing Figures

I
II
V
t

DUCT EQUIPMENT FOR EXHAUSTING COKE GASES

The invention relates to equipment for exhausting gases which are evolved in pushing and/or quenching coke from coking ovens that are charged with dust. It includes a collecting device that can be shifted from chamber to chamber and communicates with an exhaust branch or duct. A stationary collection duct for exhausting the gases is located substantially parallel to the shift track of the collecting device and has on its topside an uninterrupted slot-like longitudinal opening which can be covered by at least one flexible belt. A cover truck which can be driven parallel to the longitudinal opening, is connected to the exhaustion branch and has return rollers for lifting the flexible belt off the collection duct in the region where the exhaustion branch opens. A belt protection device is located at a distance from the flexible belt along the collection duct in order to separate the gas stream in the collection channel from the flexible belt.

German Laid-Open Application No. 2,201,963 discloses equipment for exhausting gases which are evolved on pushing coke from coking ovens that are charged with dust. Along the coke side of the coke-oven battery, a gas collection duct is provided, the open topside of which is covered with a flexible belt of heat-resistant material. A hood which can be driven together with the coke batch guide and has an inlet opening or feed line for the gases charged with dust is located on the gas collection duct. In the interior of the hood, rollers are provided to effect lifting of the flexible belt and opening of the gas collection duct. Thus, the flexible belt is directly exposed to hot extraction gases which are laterally sucked into the hood.

For this reason, the belt must be manufactured from a heat-resistant material which, moreover, must be wear-resistant. However, heat-resistant material, for example, wire fabric interwoven with asbestos, is not only relatively expensive, for example, compared with rubber, but is also less elastic and not particularly wear-resistant, so that the belt must be frequently renewed.

Furthermore, German Laid Open Application No. 2,326,630 discloses equipment for exhausting gases which are evolved on pushing and/or quenching coke from coking ovens that are charged with dust. A collecting device which can be shifted from chamber to chamber and communicates with an exhaustion branch, with a stationary collection duct for exhausting the gases, is located substantially parallel to the shift track of the collecting device. On its topside is provided an uninterrupted slot-like longitudinal opening which can be covered by at least one flexible belt. A cover truck which can be driven parallel to the longitudinal opening is connected to the exhaustion branch and has return rollers for lifting the flexible belt off the collection duct in the region where the exhaustion branch opens. A cooler designed as a tube bundle is provided between the dust-catching hood and the connection truck for joining the exhaustion branch to the collection duct. Although this makes possible a certain pre-cooling of the hot exit gases before they enter the collection duct, it entails a heat exchanger of a relatively high weight so that the mobile extracting device becomes rather heavy.

It is the object of the invention to develop the last-mentioned known equipment in such a way that the effect of the heat of the extraction gases, flowing into the collection duct, on the flexible belt is reduced to a minimum by simple means.

An earlier proposal by the Applicant in German application P25 13 449.0-24 provides protective plates which are located in the collection duct at a distance from the flexible belt. The plates are arranged along the collection duct at substantially equal distances and extend at least over the cross-sectional inlet area of the collection duct in order to separate the gas stream in the collection duct from the flexible belt. Cooling tubes are arranged which extend transversely to the collection duct between the flexible belt and the protective plates and the outlet orifices for cooling air point toward the belt in the direction of flow of the gases.

The subject of the earlier proposal thus already includes a belt protection device located at a distance from the flexible belt along the collection duct in order to separate the gas stream in the collection duct from the flexible belt.

By contrast, the subject of the present invention provides that the belt protection device is a second inner collection duct which runs in the outer collection duct and has openings facing away from the belt.

Advantageously, the hot gases thus flow only in the inner collection duct, that is to say they have no contact with the belt of flexible material, for example, rubber.

The effect of the heat of the extraction gases, flowing into the collection duct, on the flexible belt is thus kept extremely small, using relatively simple means, by the second inner collection duct provided by the invention. The heat transported by the extraction gases in the second collection duct in the direction of the belt cannot be transferred to a significant extent to the belt by convection, or by conduction, or by radiation of heat either, in particular, because the openings of the second inner collection duct face away from the belt. Thus, separation of the flexible belt from the hot extraction gases is obtained over the entire length of the first or outer collection duct, so that commercially available wear-resistant rubber belts can be used for covering the collection duct without having to fear excessive heating which endangers the belt. Rubber belts are not only cheap, but they also display good contact, and hence a good sealing effect.

Although the openings of the inner or second collection duct are in positions facing away from the belt, no difficulties arise in the outflow of the extraction gases from the exhaustion branch to the inner collection duct because there is a reduced pressure in the latter.

Since, as already stated, no heat losses from the inner collection duct toward the flexible belt occur, the inner collection duct also acts as a heat store for the extraction gases flowing to the de-duster. Thus, the extraction gases hardly cool and, for the same reason, hardly any constituents of the extraction gases deposit on the inner wall of the inner collection duct, and this not only keeps the corrosion of the wall low, but also renders the danger of a blockage of the inner collection duct negligible.

If the length of the cover truck in the direction of driving is substantially equal to the width of the chamber, it is advantageous when unbroken bulkheads are provided at the pitch of a chamber between the inner collection duct and the outer collection duct.

In this way, even a minor lateral escape of extraction gases, when they flow away from the exhaustion branch to the openings, facing away from the belt, of the inner collection duct, is prevented, or the reduced pressure in the inner collection duct can be held relatively small.

It is also advantageous when each of the bulkheads has, on the side facing away from the belt, a cut-out immediately adjacent to the wall of the outer collection duct and when the cut-outs are in alignment.

On the one hand, due to their small dimensions, these cut-outs do not impair the extraction of gases being extracted through the inner collection duct, but, on the other hand, since they are in alignment, they enable the outer collecting duct to be simply cleansed from any precipitates which may have deposited from the extraction gases on its wall facing away from the flexible belt, by flushing through with a cleaning liquid, preferably water.

The manufacture of the inner collection duct with the openings is made particularly simple when the openings, facing away from the belt, of the inner collection duct conjointly also form an uninterrupted slot-like longitudinal opening.

It is also an advantage that the uninterrupted slot-like longitudinal opening of the outer collection duct is provided with a grate.

This is because the vertical elements of the grate assist in letting the extraction gases flow in the shortest possible path from the exhaustion branch to the openings of the inner collection duct, the lateral screening achieved by the bulkheads also being complemented. At the same time, the grate serves as the carrier for the flexible cover belt.

Finally, favourable flow conditions and simple manufacture of the equipment are promoted when the inner and the outer collection duct have a substantially circular cross-section.

In order to ensure that the equipment according to the invention operates satisfactorily under all circumstances, that is to say, even if the reduced pressure within the inner collection duct with respect to the atmosphere is relatively small and can lead to difficulties in the outflow of the extraction gases from the exhaustion branch to the inner collection duct, the invention has the purpose of providing effective protection of the belt without noticeably hindering the outflow of the extraction gases from the exhaustion branch. For this purpose, it is provided according to a further embodiment of the invention, that the belt protection device has the cross section of an arc, preferably a circular arc, lying symmetrically to the vertical symmetry plane of the outer collection duct and the curvature of the cross section of the arc faces away from the belt. Advantageously, the circular arc spans an angle of about 60°.

By way of example, the invention is explained in more detail by reference to the drawing in which:

FIG. 1 shows a cross section along the line I—I in FIG. 2 through the unit of inner and outer collection ducts of the equipment;

FIG. 2 shows a longitudinal section II—II of FIG. 1 including a cover truck;

FIG. 3 shows a cross section along the line III—III in FIG. 4 through a modified embodiment of the unit according to the invention, in which the belt protection device has the cross section of a circular arc;

FIG. 4 shows a longitudinal section along the line IV—IV in FIG. 3 with the cover truck; and FIG. 5 shows a cross-sectional view taken generally along the plane V—V of FIG. 2.

DESCRIPTION OF THE FIGURES

A segment is cut off the topside of a first outer collection duct 1 with a circular cross section, a collection duct extension 2 which consists of parallel walls and ends in horizontal flanges 2a being, for example, welded to the ends of the segment. An uninterrupted upper opening of the duct extension 2 is filled by a grate 3 with an open grid. In other words, the duct extension 2 has a single, uninterrupted, longitudinal opening and carries a grate means or grate 3 within the opening, the grate 3 presenting a plurality of openings communicating with the interior of the duct 1.

A flexible belt 4, for example, of rubber, rests on the grate 3 and the flanges 2a of the duct extension 2. The flexible belt 4 can be lifted off the grate 3 and the flanges 2a by means of a cover truck 6 which can be driven on rails 15 in the longitudinal direction of the collection duct 1 by means of rollers 12 and to which return rollers, such as 7, around which the belt 1 is wound in the manner seen from FIG. 2, are fastened (in this context, see also, for example German Published Application No. 2,326,630).

Figures 1, 2, 5:
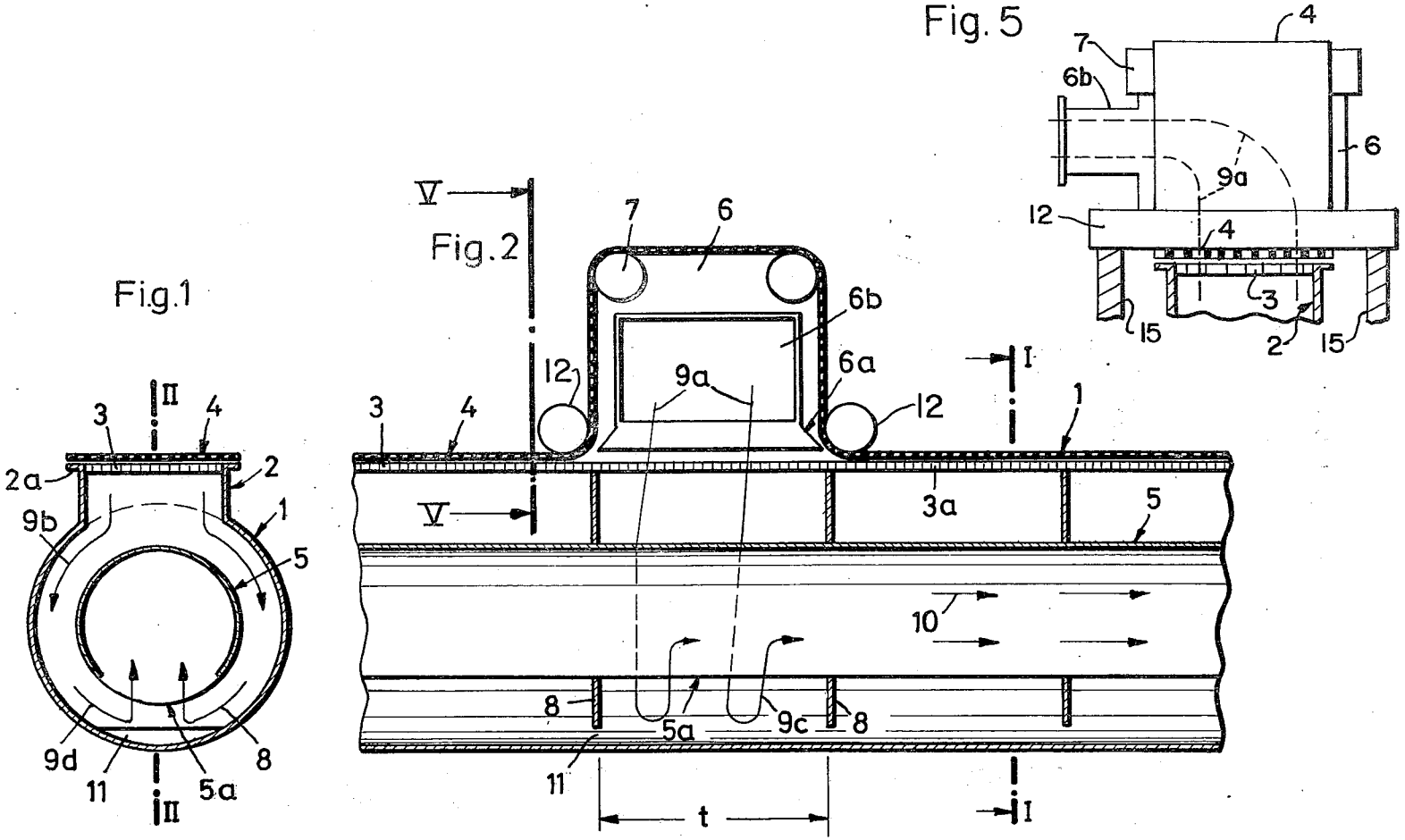

The cover truck 6 has an exhaust duct or exhaustion branch 6b for the extraction gas, the branch being indicated only diagrammatically and communicating with a collecting device (not shown), which can be shifted from coke chamber to coke chamber, for the gases which are evolved on pushing and/or quenching coke from the particular coking oven and which are charged with dust. A possible embodiment of the cover truck 6 with the exhaust duct or exhaustion branch 6b is more completely and exactly described, for example, in the earlier proposal (P25 13 449.0-24).

In the interior of the first outer collection duct 1, a second inner collection duct 5 is located which has an uninterrupted slot-like longitudinal opening 5a on the side facing away from the belt 4. The inner collection duct 5 which is connected to a de-duster (not shown, to be visualized on the right in FIG. 2) is carried by the bulkheads 8 which have the shape of an essentially circular ring and are, for example, welded to the two collection ducts 1 and 5.

The bulkheads 8 are placed at the pitch t of a coke chamber in such a way that the lower exhaust duct or extension 6a of the exhaustion branch 6b always lies between two adjacent bulkheads 8 for the purpose of extracting the gases to be extracted in the direction of the arrows 9a to 9d on the shortest possible path, that is to say, with the least possible flow resistance, to the slot-like longitudinal opening 5a on the side, facing away from the belt, of the inner collection duct 5 in order to be able to manage with a relatively small reduced pressure in the inner collection duct 5. In the latter, the gases then flow to the de-duster in the direction of the arrow 10.

For the extraction gases flowing in the direction of the arrow 10 through the inner collection duct 5, the latter acts as a heat store on its length up to the de-duster, that is to say, the extraction gases hardly cool, so that hardly any constituents of the extraction gases deposit on the inner wall of the inner collection duct 5; for this reason, the corrosion of the wall is low and, furthermore, there is no danger of a blockage of the inner collection duct 5. Advantageously, each of the bulkheads 8 has, on the side facing away from the flexible belt 4, a cut-out 11 in the shape of a segment of a circle so that, on the one hand, due to their small dimensions, all the cut-outs 11 conjointly do not impair the extraction of the gases being extracted through the inner collection duct 5, but, on the other hand, since they are in alignment, enable the outer collection duct 1 to be cleaned in a simple manner from any precipitates which may have deposited from the extraction gases on its wall facing away from the flexible belt 4, by flushing through with a cleaning liquid, preferably water.

The vertical elements 3*a* of the grate 3 also assist to some extent in aligning the extraction gases so that they flow on the shortest possible path to the uninterrupted longitudinal opening 5*a* of the inner collection duct 5; in particular, the grate complements the lateral screening achieved by the bulkheads 8.

Thus, it can be seen that the equipment achieves in a simple manner an effective protection of the flexible belt 4 against the extraction gases, such as has not been possible hitherto, since the extraction gases are exhausted outwards to the de-duster only in the inner collection duct 5, which is indicated by the arrows 9*a* to 9*d*.

Figure 4:
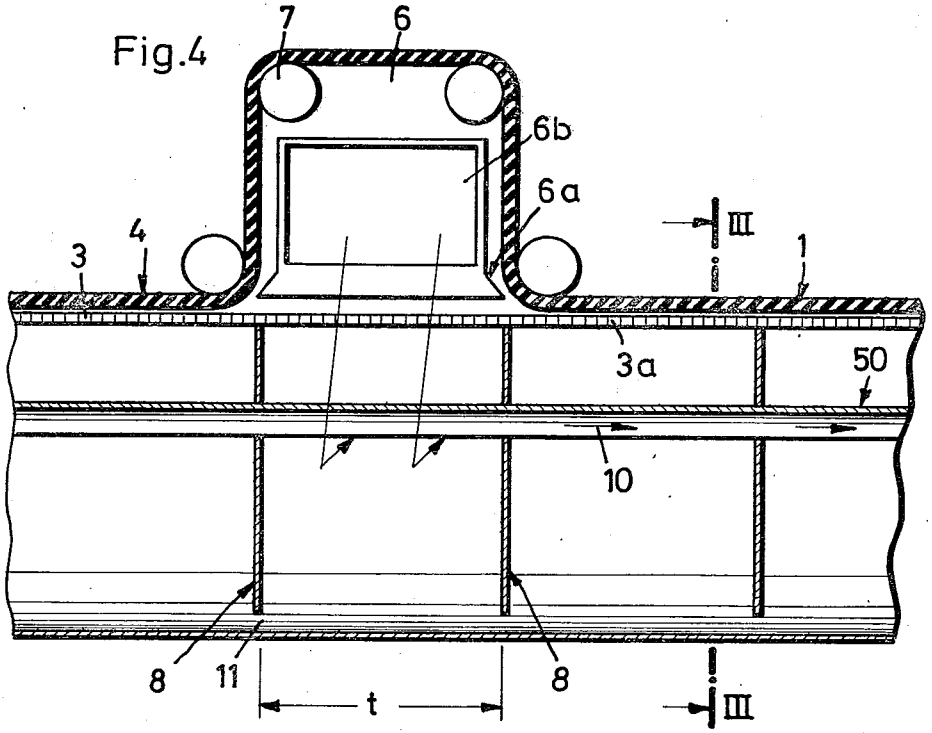
Figure 3:
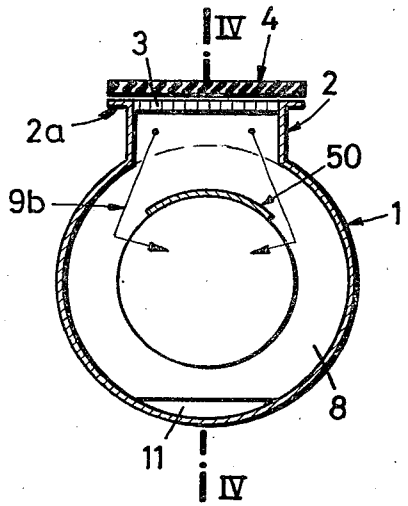

The parts which correspond to those in FIGS. 1 and 2 are provided with the same reference symbols in FIGS. 3 and 4. The modified embodiment shown in these figures differs in the main in the following features:

An inner collection area, defined by a curved baffle, plate, or partial duct 50, which curves away from the belt 4 and represents, in the illustrative embodiment shown, a circular arc with an aperture angle of about 60°, is located in the interior of the outer collection duct 1. The collection area 50 which is connected to a de-duster (not shown, to be visualized on the right in FIG. 4) is supported by bulkheads which have the shape of an essentially circular ring and are, for example, welded to the collection duct 1 and to the collection area 50.

The bulkheads 8 are here also placed at the pitch t of a coke chamber in such a way that the lower extension 6*a* of the exhaustion branch 6*b* always lies between two adjacent bulkheads 8 for the purpose of extracting the gases to be extracted in the direction of the arrows 9*a*, 9*b* on the shortest possible path, that is to say, with the least possible flow resistance, to that region of the collection area 50 which faces away from the belt or is the lower region, in order to be able to manage with a relatively small reduced pressure. The gases then flow to the de-duster in the direction of the arrow 10.

As in FIGS. 1 and 2, each of the bulkheads 8 has, on the side facing away from the flexible belt 4, a circular cut-out 11 so that, on the one hand, due to their small dimensions, all the cut-outs 11 together do not impair the extraction of the gases to be extracted below the collection area 50 but, on the other hand, since they are in alignment, enable the outer collection duct 1 to be cleaned in a simple manner from any precipitates which may have deposited from the extraction gases on its walls facing away from the flexible belt 4, by flushing through with a cleaning liquid, preferably water.

The vertical elements 3*a* of the grate 3 also assist to some extent in aligning the extraction gases so that they flow on the shortest possible path under the collection area 50; in particular, the grate complements the lateral screening achieved by the bulkheads 8.

Thus, it can be seen that the equipment according to FIGS. 3 and 4 on the one hand achieves in a simple manner an effective protection of the flexible belt 4 against the extraction gases since the latter essentially only flow below the collection area 50 along the outer collection channel 1, but, on the outer hand, due to the smaller dimension of the collection area 50 compared with an inner collection duct extending almost over the full circumference of the circle, the exhaustion of the extraction gases from the exhaustion branch 6*b* for the extraction gas is not in any way impeded at a particular time by an excessively large flow resistance of the collection area 50.

It is, of course, intended to cover by the appended claims all such modifications as fall within the true spirit and scope of the invention.

What is claimed is:

1. Equipment for exhausting gases from a movable gas collecting truck, said equipment comprising a stationary outer collection duct for exhausting the gases defining along an upper surface a slot-like opening, a plurality of divider means in said outer collection duct extending across portions of the interior axial cross section of said duct at longitudinally spaced locations to define a plurality of longitudinally spaced chambers, a flexible belt in contact with and covering said opening, a collecting truck being disposed on said outer duct beneath said belt and in communication with said opening, means for shifting said collecting truck from chamber to chamber along said duct while lifting the belt off the collection duct to permit movement of said truck and exhausting of gases from the collecting truck to the collection duct, and an arcuate belt protection member disposed within said outer collection duct and longitudinally extending through and between each of said divider means, said belt protection member spaced from the belt for inhibiting the flow of gas against said belt and defining on its side opposite said belt an inner collection channel for directing exhaust gases received from the collecting truck in a given chamber out through the inner collection channel while preventing contact of said exhaust gases with the belt to prevent deterioration thereof.

2. Equipment in accordance with claim 1 in which said outer collection duct and said arcuate belt protection member each have a substantially circular cross section.

3. Equipment in accordance with claim 1 in which the outer collection duct is circular in axial cross section and the arcuate belt protection member has an arcuate axial cross section symmetrically aligned with the vertical plane of symmetry passing through the axial cross section of the outer collection duct and in which the concave curvature of the belt protection member faces away from the belt.

4. Equipment according to claim 3 in which the arcuate axial cross section of said belt protection member spans an arc of about 60°.

5. Equipment according to claim 1 further including a grate disposed within said slot-like opening of the outer collection duct.

6. Equipment according to claim 1 in which said plurality of divider means in said outer duct extending across portions of the interior axial cross section of said duct comprise a plurality of generally planar bulkheads having a spacing substantially equal to the length of the collecting truck from which the exhaust gases being collected emanate.

7. Equipment according to claim 6 in which the bulkheads define aligned cut-outs located on the side opposite the belt adjacent the outer collection duct whereby the bottom inner surface of the outer collection duct can be cleaned.

* * * * *